United States Patent [19]

Timbes et al.

[11] 4,198,043

[45] Apr. 15, 1980

[54] WATER SLIDE WITH MODULAR, SECTIONAL FLUME CONSTRUCTION

[75] Inventors: Larry C. Timbes, Myrtle Beach; Julian H. Price, Florence, both of S.C.

[73] Assignee: Plexa Incorporated, Florence, S.C.

[21] Appl. No.: 913,185

[22] Filed: Jun. 6, 1978

[51] Int. Cl.[2] ..... A63G 21/18

[52] U.S. Cl. ..... 272/56.5 R; 46/1 K; 104/70; 193/2 R; 405/119

[58] Field of Search ..... 272/56.5 R, 56.5 SS, 272/1 B, 32; 104/69, 70, 72, 73, 56, 57, 63, 64, 67, 70, 72, 73, 134, 135, 136, 59, 86; 193/2 R, 2 A, 25 E, 12, 13, 27, 28, 33, 38

[56] References Cited

U.S. PATENT DOCUMENTS

| | | | |
|---|---|---|---|
| 1,993,945 | 3/1935 | Peterson | 193/12 |
| 3,343,793 | 9/1967 | Waser | 104/69 X |
| 3,508,405 | 4/1970 | Koch | 405/121 |
| 3,712,541 | 1/1973 | Merino et al. | 46/1 K X |
| 3,860,237 | 1/1975 | Cooper et al. | 46/1 K X |
| 3,923,301 | 12/1975 | Myers | 272/56.5 R |
| 3,958,361 | 5/1976 | Cooper et al. | 46/1 K |
| 3,970,300 | 7/1976 | von Wendt et al. | 272/56.5 R |
| 4,109,904 | 8/1978 | Becker et al. | 272/56.5 R |
| 4,146,991 | 4/1979 | Sano | 46/1 K X |
| 4,149,710 | 4/1979 | Rouchard | 272/56.5 R |

FOREIGN PATENT DOCUMENTS

| | | | |
|---|---|---|---|
| 1109707 | 4/1968 | United Kingdom | 193/2 R |
| 1418668 | 12/1975 | United Kingdom | 272/56.5 R |

OTHER PUBLICATIONS

Alpine slide. Skateboarder Magazine, Jan. 1978, p. 157.

*Primary Examiner*—Richard C. Pinkham

*Assistant Examiner*—Arnold W. Kramer

*Attorney, Agent, or Firm*—Sughrue, Rothwell, Mion, Zinn and Macpeak

[57] ABSTRACT

A multiple flume water slide includes individual starting pools for each flume and a common landing pool mounted at different elevations on an earth foundation and connected by way of modular sectional flumes. Each flume consists of a minimal number of end reversible, end abutting, end-to-end sealed acrylic module flume sections which are generally concave upwardly away from the earth formation and are of generally semi-circular transverse cross-section, with each terminating along respective edges in integral upwardly convex hand rails. Straight sections have hand rails of the same height. Curved sections have lower radially inner and higher radially outer walls with the outer walls terminating in hand rails higher than those of the inner walls. Transition sections between a straight section and a curved section or between abutting curved sections of opposite throw have longitudinally inclined hand rails along one side from one end to the other to meet the radially outer wall hand rail of the abutting curved section. Specially constructed acrylic starting and concrete landing pools are connected to the flume by way of specially configured starting flume and landing flume sections. The flume sections are joined by the use of integral flanges at respective ends of the sections and through the use of an arcuate spacer at each joint and a packing strip radially inwardly thereof and flush with the longitudinal walls of the sections. A plurality of the flumes have water selectively circulated thereto by multiple supply and return pipes through common headers and a plurality of pumps, which pumps may be selectively operated, depending upon the extent of flumes in actual use.

19 Claims, 12 Drawing Figures

CHLORINATOR

WATER SLIDE WITH MODULAR, SECTIONAL FLUME CONSTRUCTION

FIELD OF THE INVENTION

This invention relates to artificially constructed water slides, and more particularly, to an improved multiple flume water slide with the flumes taking different and varying contours and being formed of a minimal number of modular, end-to-end joined acrylic flume sections of standard configuration and size.

BACKGROUND OF THE INVENTION

Water slides have come into recent vogue, particularly in the seashore resort areas where as a diversion to swimming in the ocean and riding the surf, the bather can ride flexible mats along predetermined shallow water flow paths as defined by flumes which carry water from a starting pool at some given vertical elevation to a landing pool displaced therefrom and at a lower elevation. Either natural water is supplied at the upper end of the starting pool and discharged at the landing pool or pumps are provided for continuously circulating the water from the landing pool to the starting pools for gravity traverse down the flumes and subsequent return for collection at the landing pool.

One such type of water slide is set forth in U.S. Pat. No. 3,923,301 issuing Dec. 2, 1975, to Dwight L. Myers.

In general, the starting and landing pools and the intervening flumes have been constructed of reinforced concrete and embedded in natural or prepared earth formations. The reinforced concrete provides particular problems with respect to climactic changes giving problems due to expansion and contraction. The water slides once created are virtually impossible to move. The surface of the concrete readily abrades the skin of the users of the water slide and in some cases presents esthetic problems.

Attempts have been made to construct water slides consisting of one or more flumes mounted on an open wooden or metal framework and in which case the flumes being made of sheet metal or laid up fiberglass provide a surface which is sufficiently smooth to permit the mat carrying the user to move with little friction, particularly with the water over the course of the flumes. Again, such structures are limited in their esthetics, are fixed in terms of the curvature or path taken by the flumes, are extensive and once assembled, again are virtually impossible to dismantle for reconstruction on a different site.

It is, therefore, a primary object of the present invention to provide an improved water slide including at least a plurality of flumes which take different and individualistic paths from given common or separate starting pools to common or separate landing pools, which can be readily mounted to the surface of a natural or prepared earth mass or on an open framework and in which the starting pool, the landing pool and the flumes interconnecting the same are manufactured of a limited number of standard interconnected arcuate and straight acrylic modular sections.

It is a further object of this invention to provide an improved water slide of the type in which the modular flume sections may be reversed to provide right or left throws for the flume water flow path as defined by end-to-end abutting flume sections, and wherein the sections include integral hand rails on each side thereof of varying height, depending upon the curvature of that section or an adjacent section thereto.

It is a further object of the present invention to provide an improved water slide of this type wherein said modular flume sections are formed of acrylic and include transition sections permitting transition between curved and straight sections or curved sections of opposite throw with proper change in hand rail height, depending upon the direction of curvature change.

It is a further object of this invention to provide an improved water slide of the type wherein a plurality of flumes extend from individual starting pools which may be at different heights and terminate at a common landing pool and wherein the water supplied to the various starting pools for given flumes may be selectively controlled to permit operation of the water slide with water flow to selected pools depending upon usage demand.

Further objects of the invention are set forth in the following paragraphs.

SUMMARY OF THE INVENTION

The present invention is directed to a water slide for an elevated earth mass or the like and which includes at least one flume mounted on the earth mass and curving about the mass along an extended descent path with said flume having upper and lower ends. A starting pool is affixed to the upper end of said at least one flume and a landing pool at its lower end, and means are provided for circulating water accumulating in the landing pool to said at least one starting pool for gravity passage over the flume surface from the starting pool to the landing pool. The improvement resides in at least the flume being formed of a plurality of end-to-end abutting and end sealed modular flume sections, such sections being generally concave upwardly and generally semi-circular in transverse cross-section and terminating along both edges in an integral convex hand rail. The sections comprise at least a straight section with straight hand rails at a common height, curved sections having radially inner and outer walls with the radially outer walls terminating in hand rails which are higher than those carried by the inner hand rail, and transition sections which extend at least between the straight sections and the curved sections and include along the radially outer wall, longitudinally inclined hand rails which are inclined upwardly in the direction from the straight section to the curved section. The flume may comprise oppositely oriented transition sections between curved sections of opposite throw with the transition sections being identical but reversed end-for-end. Preferably, the modular flume sections are formed of molded, vacuum formed acrylic, with integrally molded hand rails, and the sections terminate at their ends in radial flanges which extend at right angles from the convex side of the modular sections. Sealed connections between the flanged ends of confronting adjacent modular flume sections are effected by an arcuate spacer sandwiched between flanges of respective modular flume sections with a packing strip of somewhat less radius mounted between the opposed flanges radially inwardly of the arcuate spacer and terminating flush with the concave upper surface of the modular flume sections and being compressed between the flanges to effectively seal the modular flume sections at the flange interface.

Preferably, the water slide comprises a plurality of flumes having individual starting pools at their upper ends and a common landing pool at their bottom ends, and wherein the means for circulating water accumulating in the landing pool to the starting pools for gravity passage over the concave surface of the flume comprising a plurality of return pipes from the landing pool, a common return manifold, a common supply manifold, and individual supply pipes to the individual starting pools and a plurality of pumps selectively interconnecting the supply and return manifolds and means for selectively operating the pumps, and valve means within the pumps and permitting the pumps to be operated in dependence upon the number of flumes in operation controlled by such valve means.

DESCRIPTION OF THE PREFERRED EMBODIMENT

Figure 1:
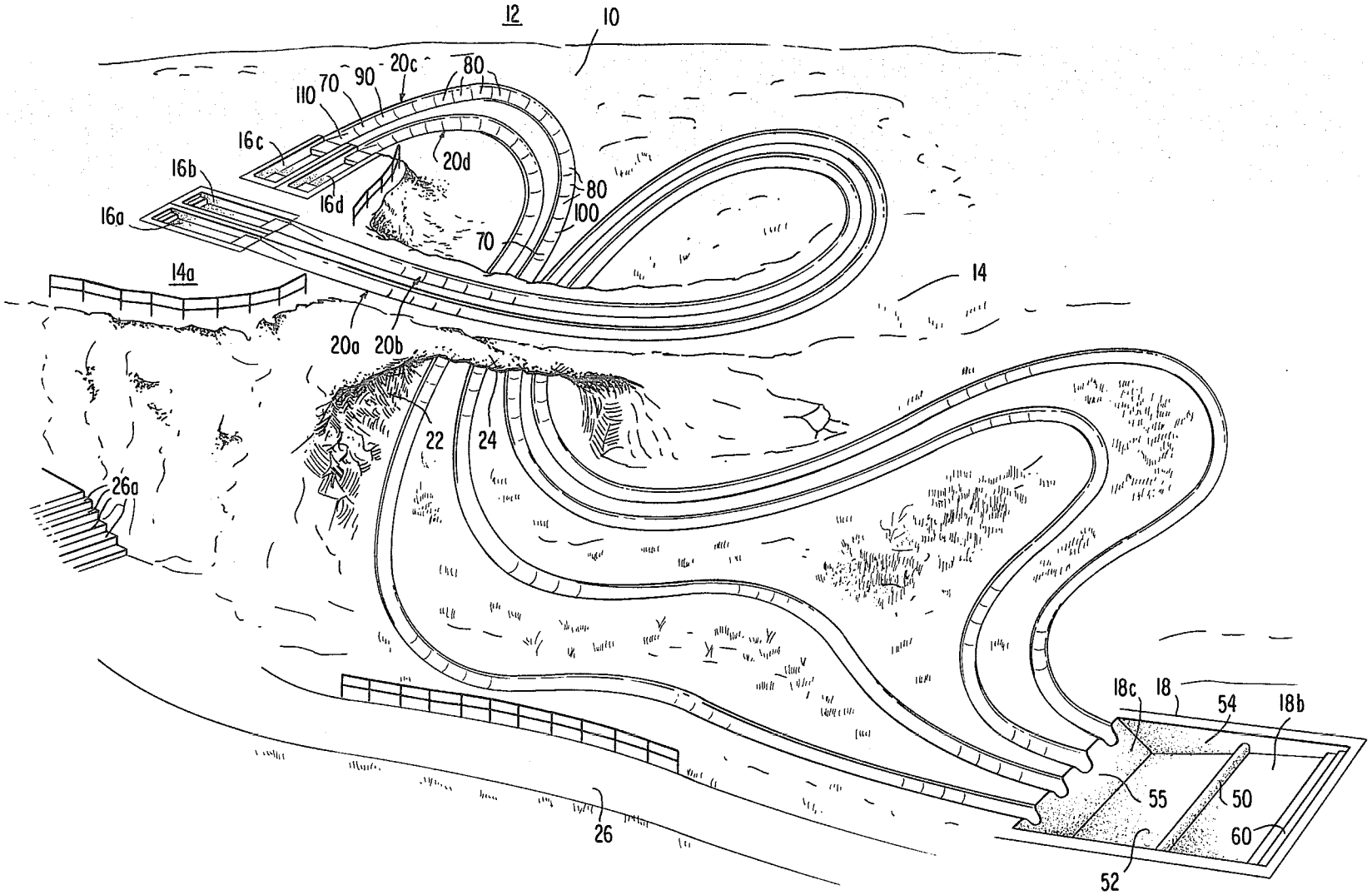
FIG. 1 is a plan view of the improved water slide of modular sectional flume construction of the present invention constituting one embodiment of the present invention.

Referring to FIG. 1, the improved water slide of the present invention is illustrated as being constructed along a beach 10 adjacent the ocean 12 or other body of water, and wherein either an artificial hill 14 is created or natural land mass of appropriate height exists to produce a peak as at 14*a* and which bears four starting pools as at 16*a*, 16*b*, 16*c* and 16*d*. The pools constitute units of two and being oriented in this case at right angles to each other. At the bottom, and in this case approximately at the level of the beach 10, is a common landing pool 18, the landing pool 18 being joined to the individual starting pools by separate flumes as at 20*a*, 20*b*, 20*c*, and 20*d*, each of the flumes being joined to its respective starting pool at its upper end and being joined at its lower end to the common landing pool 18.

In a preferred construction, the flumes rest on the surface of the earth formation or mountain 14, although they could be supported by an open wooden or metal framework, with the starting pools mounted at the top of a tower, for instance, and the landing pool being simply partially buried within the ground at a level below the starting pools. In the illustrated embodiment, the starting pool is at a height of 40 feet above the landing pool, although it is envisioned that the starting pool could be several hundreds of feet above the landing pool, in which case the flumes will provide longer water flow paths. The flumes do not have identical configuration or flow paths, although in the case shown, all of the flumes pass through a tunnel 22 created by a causeway 24 which bridges two portions of the mass and which supports flumes 20*a* and 20*b* which pass over each other at the causeway 24. It may be desirable to permit overflow of the water on the causeway and to create a waterfall through which the users of the water slide pass during their runs from the starting pools to the common landing pool.

In order to reach the starting pool, preferably there is provided a walkway 26 which extends along the side of the mountain or earth formation 14, the walkway 26 may of course incorporate steps as at 26*a*, depending upon the nature of the terrain which must be traversed to reach the starting pools from the landing pool. Appropriately, a fence or other guard as at 28 may be provided to keep the pedestrians on the walkway 26 away from the persons sliding downwardly within the flumes, particularly flume 20*d*.

The present invention is directed particularly to the creation of multiple, modular, molded plastic, sectional flumes of acrylic construction, perferably of rigidized Plexiglass D.R., and employing a plurality of standard sections which may be selectively joined end-for-end and to form diverse water flow paths of varying configuration and slope. The acrylic sections for the various flumes, as is conventional, are preferably vacuum form molded and bear an acrylic coat on the surface carrying the water, that is, their upper surface facing away from the mountain or earth formation 14. It has been determined that where the users sit or lie upon mats formed of closed cell polyurethane foam, due to the relatively low friction of the acrylic, the slope of the flume as an average should be no greater than 8.5%, although for individual inclined sections between given horizontal sections the angle of slope may be increased to 25%. Utilizing standard sections both in terms of straight sections, curved sections, transition sections, starter flume sections and landing sections, the length and number of the flumes is immaterial. The improved water slide may be easily and economically assembled on a given site and may be subsequently dismantled and removed to another site. In this respect, therefore, not only is the flume formed of modular, preferably vacuum formed molded acrylic end-to-end sections, but the starting pool is preferably formed as a unitary molded element as is the landing pool, in this case each starter section is separately molded, while the landing pool for all four flumes is of one piece of acrylic or concrete and is coupled by way of end landing sections to the lower end of all four flumes 20*a* through 20*d*.

Figure 2:
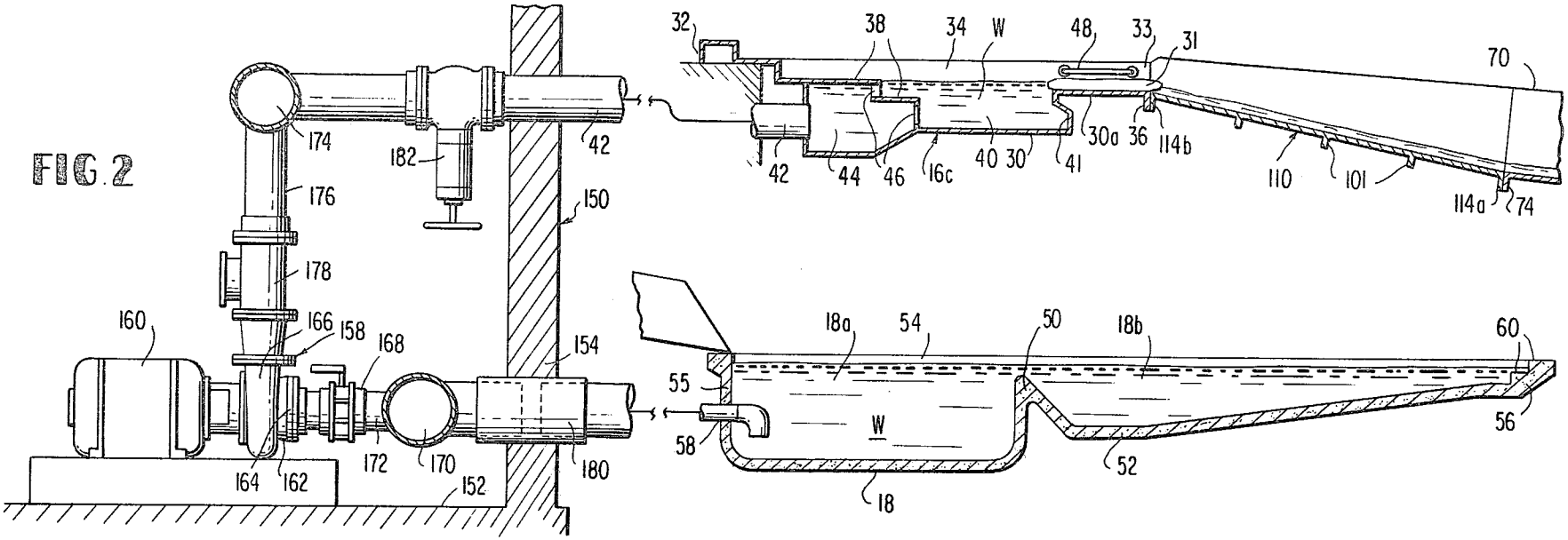
FIG. 2 is a vertical sectional view, partially broken away, of the starting pool and landing pool ends of a given water slide flume and a portion of the pump station showing the supply and return manifolds and the water circulation pumping assembly for the water slide of FIG. 1.

Reference to FIGS. 1 and 2 shows starting pool 16*c* as being of elongated rectangular boxlike form including a bottom wall 30, end wall 32, opposed sidewalls as at 34 and having its end 33 opposite end wall 32 open, but terminating in an integral, right angle flange 36 which depends downwardly from the bottom wall 30. The bottom wall 30 is stepped to form a seat 30*a* and defines with transversely extending, integral steps 38, a recessed portion 40 including a toe space 41.

Water is supplied to the interior of the starting pools such as 16*c* through a supply pipe 42 which projects into the interior of a cavity or chamber 44 defined by the end wall 32, sidewalls 34, the bottom wall 30 and steps 38, which receives the water returning to the starting pools from the landing pool after pump circulation and treatment such as filtering, chlorination, etc. In that regard, the steps 38 are provided with a transverse slot 46 permitting the water within chamber 44 to enter the recessed portion 40, overflowing the same at seat 30*a* and exiting from the starting pool at the open downstream end 33 of that element. Preferably, each sidewall 34 includes a handle bar 48 on each side of the seat 30 to facilitate the user in sitting on seat 30, with mat 31 in place, prior to movement down the flume on the mat.

Turning next to the landing pool 18, as shown in FIGS. 1 and 2, it may be seen that the landing pool is formed of a single molded concrete element, but could be formed of acrylic, having a splashdown section or chamber 18*a* and a surge chamber or section 18*b* separated by a vertical transverse baffle or surge barrier. The landing pool 18 is defined by a bottom wall indicated generally at 52 and which includes a V-shaped projection 50 extending transversely across the pool from one sidewall 54 to the other, the landing pool 18 being further defined by a vertical end wall 55 at the end receiving the flumes, and a stepped, inclined end wall 56 at the end remote therefrom, permitting the user after landing in the landing pool 18*a* and entering the surge section 18*b* to step out of the landing pool 18 for passage to walkway 26 and return to a given one of the starting pools for the next run. End wall 55 is provided with a plurality of return pipes as at 58 which are sealably mounted to that end wall and project into the landing pool section 18*a*. The landing pool is formed preferably of concrete but could be formed of molded acrylic and, if necessary, the upper surfaces being provided with abrasive stripes as, for instance, within the surge chamber 18*b* to assist the user to rise and walk to the steps 60 as defined by the end wall 56.

It should be stated that the molded fiberglass construction provided to the starting pools 16*a*–16*d* and the landing pool 18 as well as the various sections of the flumes 20*a*–20*d* is conventional and may follow the construction techniques as applied to the molding of acrylic boats and the like.

As may be best appreciated by reference to FIG. 1, it may be seen that the flume 20*a*, along with flume 20*b* which closely follows the same, exits from starting pool 16*a* in the direction of the landing pool 18 and passes over the causeway 24 prior to taking a left turn, whereupon the left turn continues, it enters a straightaway portion which changes at the tunnel 22, continues in a left turn, enters a transition area downstream of the tunnel 22, takes a right turn and terminates in a left turn just before discharging the user into the landing pool 18. In constrast, the runs provided by flumes 20*c* and 20*d* involve almost immediate right turns, straighaway sections beneath the causeway 24 and through tunnel 22, a transition to a left turn, and an immediate transition to a short right turn just prior to entering the landing pool 18. These turns, transitions, straightaways, etc., are only exemplary and obviously in a well constructed and commercial embodiment of the invention, there would be provided longer rides with a greater number of turns and possibly some drop sections of accelerated flow leading to horizontal sections for deceleration to provide a change in velocity without negatively affecting the safety aspects of the water slide.

Figure 8:
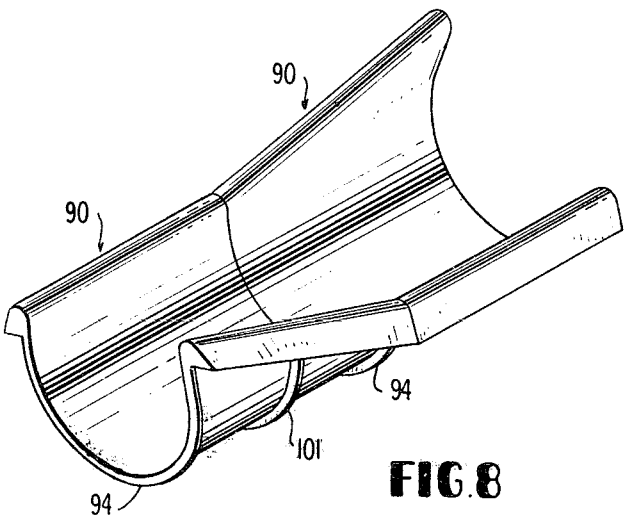
FIG. 8 is a perspective view of a pair of the transition sections of FIG. 6 with one reversed and in abutment for changing from a curve of given throw to a curve of opposite throw within the flumes of FIG. 1.
Figure 4:
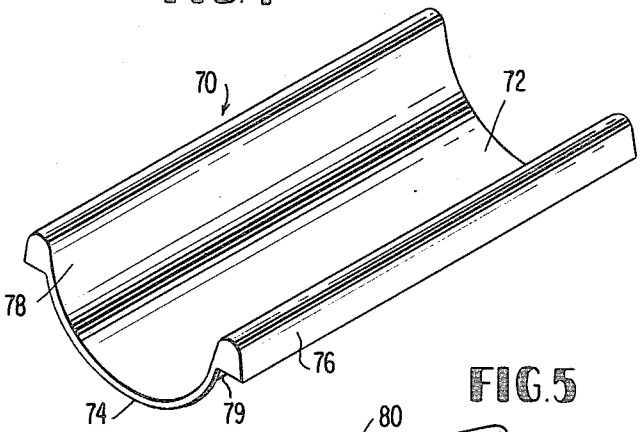
FIG. 4 is a perspective view of a straight modular flume section of the multi-flume water slide of FIG. 1.
Figure 5:
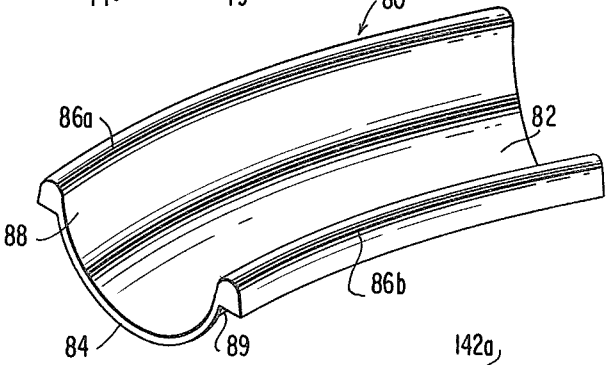
FIG. 5 is a perspective view of a modular curved flume section of the multi-flume water slide of FIG. 1.

In terms of achieving straight sections, drop sections, right and left turns, and the transitions therebetween, the present invention utilizes a minimum number of different prefabricated, modular plastic flume sections which may best be seen in FIGS. 4–10 inclusive, in varying end-to-end connected arrays. In that regard, a straight modular acrylic flume section 70 is illustrated in FIG. 4, a curved modular acrylic flume section 80 is illustrated in FIG. 5 and is simply reversed to achieve curvature of opposite throw, that is, assuming in FIG. 5 that the rider is moving on a film of water from left to right and is therefore curving to the right, by oppositely ending the curved modular acrylic flume section 80, and while moving in the same direction, the rider would curve to the left. In order to make the transition from a curved section to a straight section, since the curved sections have one rail which is higher than the other, it is necessary to employ transition sections. Therefore, the invention incorporates two different transition sections as at 90 in FIG. 6 and 100 in FIG. 7. As shown in FIG. 8, depending upon whether the transition is being made from a left turn to a straight section, right turn to a straight section, or right or left turn to straight section as the case may be in the direction of movement of the water, selection of the transition section is required.

Further, the flumes may be manufactured by joining abutting sections end-to-end, wherein a curve of one throw may terminate immediately into one of opposite curvature. In this case, there is required the joining of abutting transition sections for the appropriate change in height of the outside hand rail defined by the direction of curvature either to the right or the left as the case may be, as seen in FIG. 8. Further, due to the configuration of the rectangular flow path as defined by the seat 30*a* within the starting pool as at 16*a*, FIG. 2, there is required a starter flume as seen at 110, bearing reinforcing ribs 101, in FIG. 9, which constitutes the first flume section from the starting pool and transforms the flow path from one of rectangular transverse configuration into one of generally semicircular transverse cross-section. Further, an end landing modular acrylic flume section 120 is provided in FIG. 10 for terminating the flume at the point of juncture with landing pool 18, as may be appreciated by further reference to FIG. 1. In this case, the end landing modular acrylic flume section 120 changes the flow path for the water from one of transverse circular configuration to a rectangular flow over an inclined surface to discharge the rider into the splashdown section 18*a* of the landing pool.

All of the modular acrylic flume sections of the illustrated embodiment are characterized by the incorporation of pipe reinforced integral hand rails and transverse ribs as at 101. Further, the sections are characterized generally by a concave upper surface, that is, one facing away from the earth formation or similar structure supporting the same. Preferably, in transverse cross-section, the concave configuration is expressed as a semicircle, of constant radius, with molded acrylic flume sections terminating in integral hand rails to each side thereof, which are convex in the same upward direction and constitute extensions of the concave upper surfaces.

Looking to FIG. 4, therefore, the straight modular molded plastic flume section 70, preferably of acrylic, is comprised of an upwardly, concave central, or main portion 72 terminating at opposed ends in right angle flanges 74 which project away from concave upper surfaces at right angles. Extending for opposite sidewalls 78, 79 and integrally molded therewith are hand rails 76 which are convex on their upper surfaces. The sidewalls are of equal height. Since the water is retained within the central portion 70, there is normally no necessity to extend the flanges 74 completely to the integral hand rails 76, although this may be done if desired. The hand rails 76 may be reinforced by longitudinal, molded in pipes or tubes in the manner of pipes 107 within section 100, FIG. 7.

Turning next to FIG. 5, curved modular acrylic flume section 80 is provided with a central portion 82 which terminates at its opposite ends in right angle flanges 84 extending outwardly away from the convex lower surface. Unlike the straight section of FIG. 4, because the section 80 is curved, it is necessary to provide one sidewall which is of greater vertical height than the other, and a hand rail which is vertically higher than the opposite hand rail. In this case, the section 80 is provided with a radially outer sidewall 88 and a radially inner sidewall 89, the radially outer wall 88 extending to a greater vertical height and terminating in an integral outside hand rail **86*a* which is higher than hand rail 86*b* for the opposite, inner sidewall 89. This is necessary since there is a tendency for the occupant, water and mat on the path to ride the radially outside wall when in a turn. It is readily apparent when viewing FIG. 5, that assuming that the user enters the end of section 80 from the left and moves towards the right, that he is experiencing a right turn during such movement, and that by simply reversing the section 80 from end to end, the occupant will move along a curved path to the left. Thus, the curved sections 80 are simply joined end-to-end to complete a right or left hand curve or throw to the desired extent. However, since there will always be a higher sidewall to the outside of the curvature, with the inside wall remaining preferably at standard height, there is a requirement for transition sections between turns of different throw and between turns and straight sections, such sections, being shown in FIGS. 6 and 7, depending upon whether one is entering or leaving a left or right curve. The right entering curve transition section may be seen in FIG. 6, this section 90 having a central portion 90 terminating in opposed sidewalls as at 98 and 99 and being provided with flanges as at 94 at opposite ends in similar fashion to the previously discussed sections. In this case, the sidewall 99 terminates in an integral hand rail as at 96*b* which is of given, normal vertical height, while the opposite sidewall 98 terminates in an oblique or inclined integral hand rail 96*a* and in terms of user movement from left to right in that figure and in terms of its being coupled exemplary to a curved section as at 80, FIG. 5, which curves to the right in a downstream direction, that hand rail 96*a* must be joined to vertically raised hand rail section 86*a* of the adjacent downstream curved section 80** which connection can be readily appreciated by further reference to FIG. 5.

Figure 7:
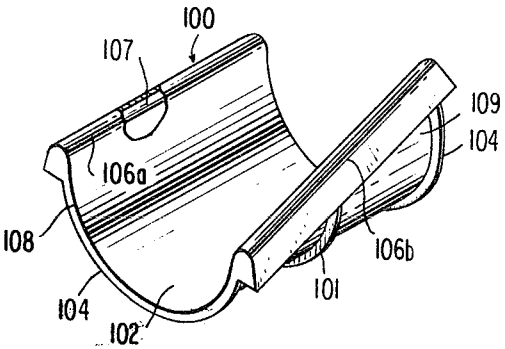
FIG. 7 is a perspective view of a second and opposite throw module flume transition section from that of FIG. 6.
Figure 6:
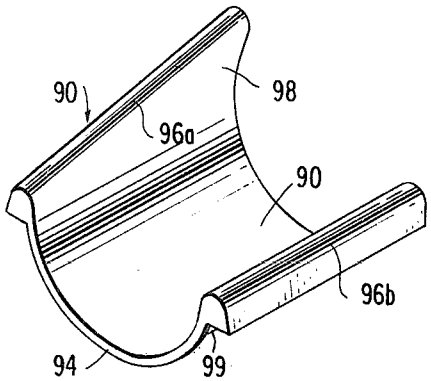
FIG. 6 is a perspective view of a first transition modular flume section of the multi-flume water slide of FIG. 1.

The transition section 100 in FIG. 7 is not the transition section 90 of FIG. 6 end-to-end inverted, it is a transition section for a left curve return section 80. In this case, in the downstream direction, the outside hand rail **86*a* of section 80 would be to the right and would be joined to a hand rail 106*b* of wall 109 of section 100 which is inclined upwardly in the direction of flow, assuming flow from left to right, with the upstream end at a common height relative to hand rail 106*a* on the opposite sidewall 108 in contrast to the hand rail 106*b*. The center section portion 102 is provided with flanges as at 104 in the identical fashion to the prior section at both ends thereof as may be appropriately seen in FIG. 7. FIG. 7 is partially broken away to show the molded in pipe at the hand rail 106*a*, the opposite hand rail being similarly formed. Further spaced exterior, unitary ribs 101** are provided intermediate the ends of sections for structural rigidity. All of the illustrated flume sections are so constructed.

Further, by reference to FIG. 8, it may be seen that a transition may be made between a right hand curve to a left hand curve by simply taking two transition sections such as transition sections 90, reversing one and end-connecting the two by joining the two at flanges 94. In this case, and assuming movement from left to right in FIG. 8, the user enters the first transition section 90 at the upstream end of the assembly of FIG. 8, from a curved section 80 (not shown) which curves to the left and leaves via the downstream transition section 90 into a curved section 80 (not shown) which is oppositely oriented and curves to the right. If the transition were from a curved section which curves right to one which curves left, one would employ oppositely end-abutting transition sections 100, as per FIG. 7.

Figure 11:
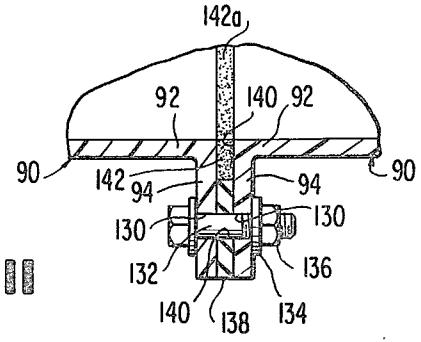
FIG. 11 is a longitudinal sectional view of portions of two end joined modular flume sections in accordance with the preferred coupling mode.

Prior to discussing the special starter flume section 110 and the end loading flume section 120, reference is made to FIG. 11 showing the nature of coupling of two flume sections, as for instance two transition sections 90 in FIG. 8. In this respect, each of the sections includes the flanges 94 which face each other and which are provided at circumferentially spaced locations with holes as at 130 through which project suitable bolts 132, the bolts carrying washers as at 134 and nuts 136 such that the flanges 94 may compress an interposed annular spacer or strip 138, the strip being provided with holes 140 permitting the bolt 132 to pass therethrough. The annular spacer or strip 138 has an internal diameter which is less than that of the internal diameter of the central portions of the two transition flume sections 90 being joined, so as to leave an annular gap between the flume sections. Mounted within that annular gap is an annular sealing strip 142 of appropriate internal and external diameter, the internal diameter being such that the radial edge **142*a* of that strip lies flush with the gel coated interior or concave upper surface of the transition flume sections 90**. Alternatively, the gap may be filled with suitable calking material, with the excess removed and the exposed surface of that calking material being flush with the interior or upper surface of the joined modular flume sections. Identical sealed coupling of the sections at the flanges is achieved throughout flumes of the present invention as well as forming appropriate joints in FIG. 2 between the starting pool and the starter flume section which lies downstream of the same.

Figures 9, 10, 12:
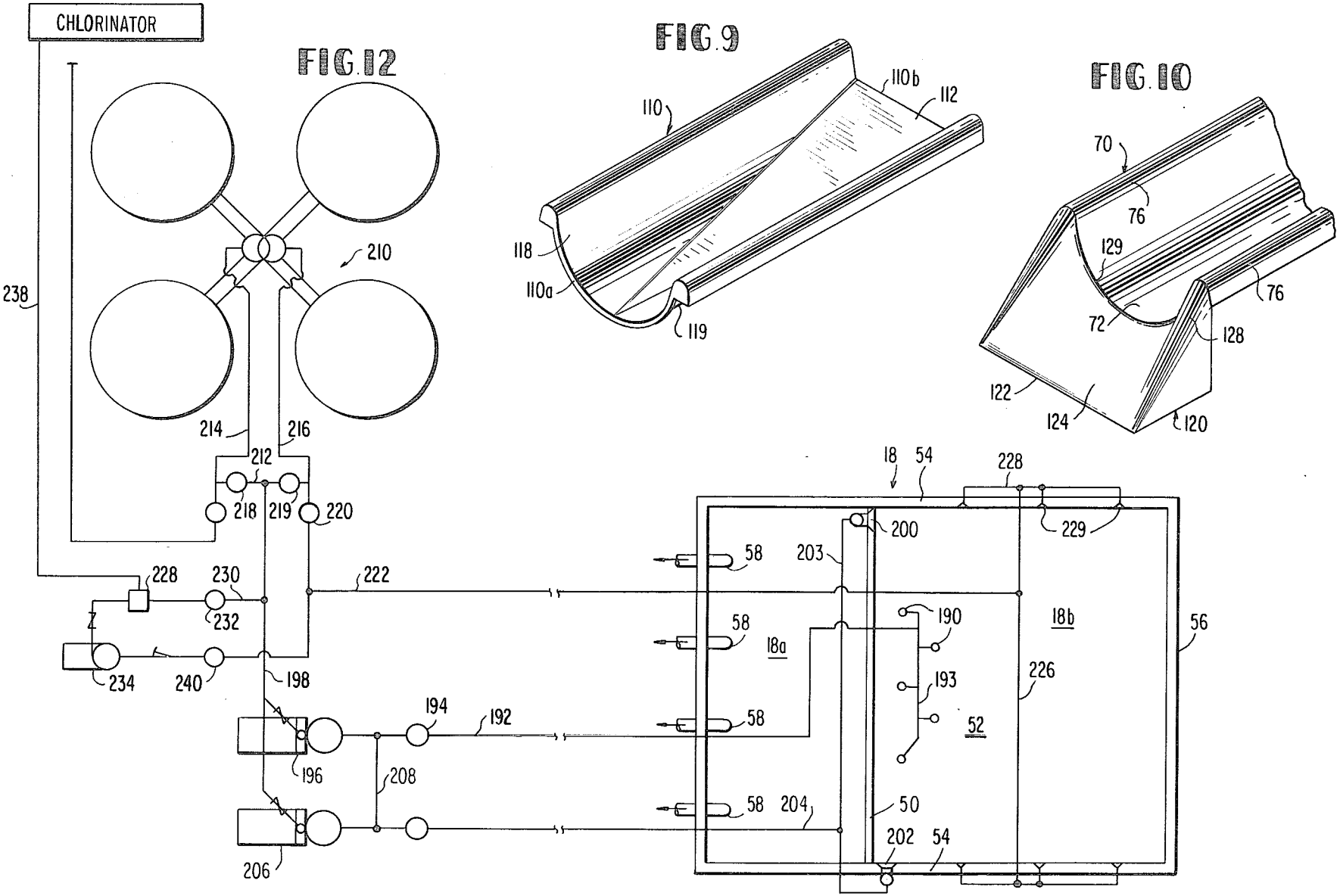
FIG. 9 is a perspective view of a starter flume section for joining the flume at its upper end to the starter pool.
FIG. 10 is a perspective view of an end landing section and a portion of a modular flume straight section for terminating the flume at its lower end at the landing pool.
FIG. 12 is a partial top plan view of the landing pool and schematic diagram of the hydraulic circuit for the water slide of FIG. 1.

In that respect, reference may be made to FIG. 9 which illustrates in perspective view, the starter flume 110. The central portion 112 of the starter flume differs characteristically from the prior described flume sections in that while it has at one end a transverse crosssectional configuration which is semi-circular at its opposite end 110*a*, its cross-section is essentially rectangular. Thus, the sidewall 118 adjacent the end 110*b* is essentially vertical and flat, the same being true for the opposite sidewall 119, while at the opposite ends the walls are curved. Transverse, longitudinally spaced ribs 101 structurally reinforce this flume section. In similar fashion to the straight flume section 70, the opposed hand rails as at 106*b* and 106*a* are at the same vertical height throughout their complete extent. Appropriately, the starter flume 110 may be joined to a straight section as at 70 at end 110*a* by way of flange 114*a*, while at its opposite end 110*b* it may be joined by way of flanges 114*b* to flange 36 at the open end 33 of starting pool 16*a*, for instance, FIG. 2. The joining of flanges 114 and 36 may be accomplished in the same manner as per FIG. 11.

Turning next to FIG. 10, the prespective view shows a straight section 70 terminating in an end joined, end landing section indicated generally at 120, the end landing section 120 simply resting by way of its forward edge (in a downstream direction of water flow) as at 122 on the upper edge of vertical wall 55 of the landing pool 18. The end landing flume section 120 is provided with a sloped, upwardly facing front wall 124 and opposite sidewalls 126. The sidewalls 126 and the front wall 24 merging into curved arm transition surface portions 128 which are joined to the opposed hand rails 76 of the straight section 70 and acting as extensions thereof. The end landing section 120 is provided with flanges (not shown) identical to the flange 74 of the straight section to which it is joined by the joint or connection as shown in FIG. 11. The upper edge 129 of the front wall 24 terminates in a curvature corresponding exactly to the curvature of the straight section main or central portion 72 and providing no discomfort or impediment to the movement of the mat and the user at the discharge end of the flume provided by this portion of the structure.

By reference to FIG. 1 and particularly flume 20*c*, it may be seen that the upstream portion of that flume is constructed of end-to-end abutting bolted and sealed flume sections, being initiated by the starting pool 16*c*. The starting pool 16*c* is bolted at its downstream end to starter flume section 110 and in turn that starting flume section 110 is bolted to a straight section 70, succeeded by a transition section 90 and a plurality of curved sections 80 defining a curve to the right. Further, at the downstream end of the first curve, the curved flume sections 80 terminate in a transition flume section 100 which joins the last of the curved sections 80 at this point to a number of end-to-end joined straight sections 70 which extend beneath the causeway 24. Of course, all of the flumes 20*a*–20*d* are similarly constructed of modular sections, and the sections can be varied to provide the desired curvature by permitting mass production of the same. FIG. 1 is illustrated only to a partial extent in terms of the individual flume sections forming the principal aspect of the present invention.

Figure 3:
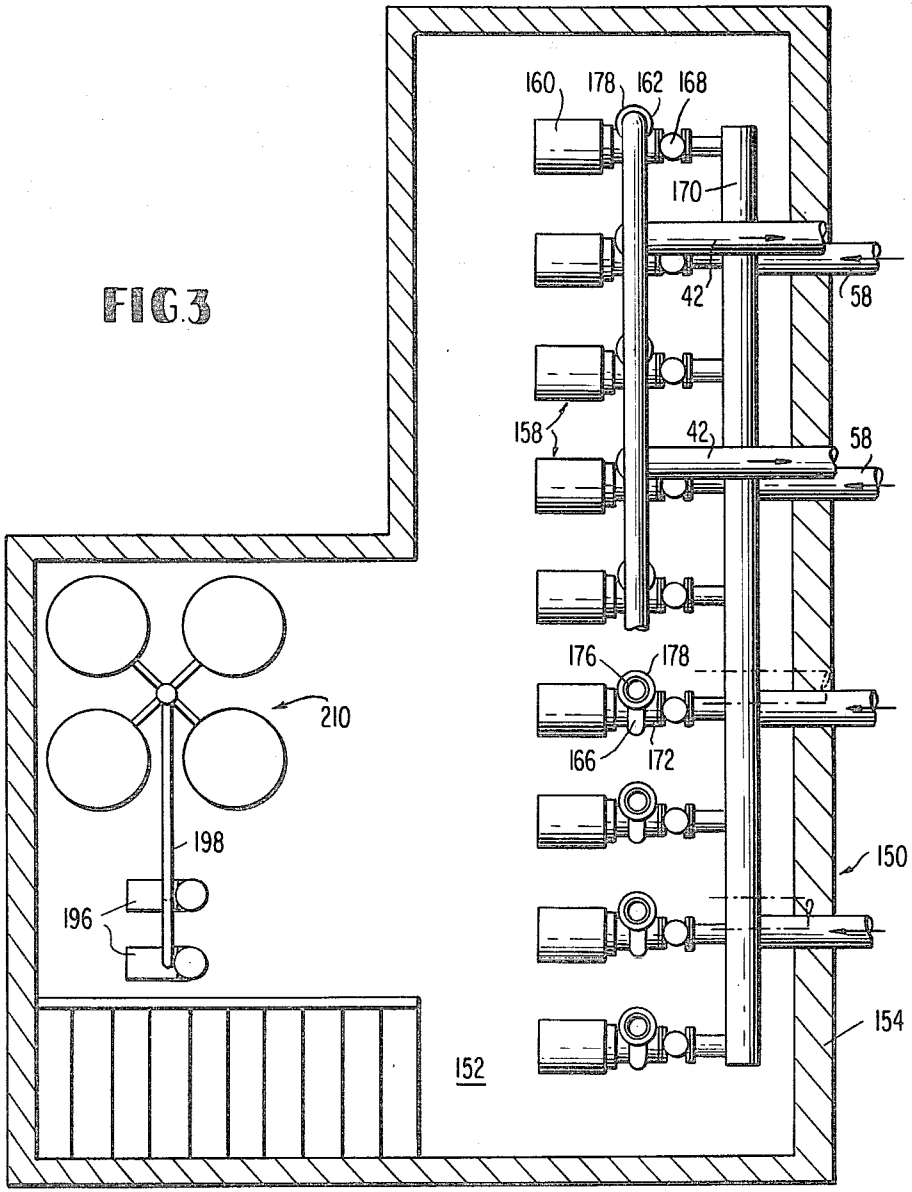
FIG. 3 is a horizontal sectional view of the pump station forming a portion of the embodiment of FIG. 2 and showing the supply and return manifolds and pumping assembly and the filter system for the water slide of FIG. 1.

Assuming that the water slide is constructed in modular sectional form in the manner previously described, it is readily apparent that the water W within the starting pools simply flows down the various flume sections for discharge and accumulation within landing pool 18, as also shown in FIG. 2. The water must be pumped at proper velocity and flow from the landing pool back to the starting pool and properly treated by chlorination, filtering, etc. This is achieved essentially by the apparatus of the pumping station or building 150, FIGS. 2 and 3, in a structural arrangement constituting a further aspect of the present invention.

In that respect, the building 150 comprises a floor at 152 and vertical sidewalls at 154 defining a pumping room 156 within which are positioned in this case, nine identical pumping units indicated generally at 158 including 20 horsepower motors as at 160 and centrifugal pumps 162. Each pump 162 includes an inlet 164 and an outlet 166, the inlet 164 being coupled through a control valve 168 to a common suction header or manifold pipe 170 by suitable connector 172. Further, the outlet 166 of each pump 162 is coupled to a common discharge header or outlet manifold 174 through piping 176 which includes a check valve 178, permitting flow from the pump outlet 166 to the discharge header 174 but not in the reverse direction. Leading to the suction header or supply manifold 170 are four of the supply pipes 58, the connection being made through the vertical building wall 154 by way of coupling 180. Further, the water W may be recirculated back to the starting pools through four of the discharge or supply pipes 42, each controlled by a shut off valve 182 which may constitute hand operated gate valves or the like of conventional construction. The valve 168 may constitute a butterfly valve for shutting off flow to the inlet 164 of a given pump 162, as desired. As may be appreciated, therefore, by reference to FIGS. 2 and 3, water W is simply recirculated on a user demand basis. In the water slide of the present invention, where the slide is employed in geographical locations of moderate temperature, during the spring and fall months or during a slow period of the day, as in late evening during the summer months, it may be desirable to operate only one or two of the flumes, as for instance flumes 20*a* and 20*c*. In this case, obviously, it is not necessary to employ all nine of the pumps 162. In fact, even when operating all four flumes 20*a*–20*d*, sufficient water may be circulated by utilization of but six of the pumps. This allows three of the pumps to be in reserve and utilized during breakdown of any one of the pumping units 158. The pumping units therefore are capable of being taken off the line since they all receive water selectively from the suction header 170 and since by closing of the butterfly valves 168 for any given pumping unit, the pump and motor are not only taken off the line, protected by way of the check valves 178 on the outlet side of the pump, but the pumps can be dismantled, the motors replaced, the pumps replaced, etc., without the necessity to shut down the water slide. Further, since the pumps 162 all discharge to a common discharge header 174 and since the supply lines 42 which connect the varied starting pools to the discharge header 174 carry control valves such as 182, these control valves may be selectively opened and closed to cause water to be fed to selected ones of the starting pools which are then open to use.

In order to properly treat the water W being circulated to meet the sanitary requirements for the community in which the water slide is being employed, it is necessary to circulate the water W through a filter system and subject it to chemical treatment. The present invention illustrates such a system as another aspect of the present invention which is separate from the water circulation system previously described. In that respect, by reference to FIG. 12, it may be seen that the landing pool 18 not only incorporates four water return pipes as at 58, but in addition there is provided within the surge section 18*b* of the landing pool and to the side of the transversely extending vertical baffle 50, a plurality of drains 190 within the bottom wall 52 of the landing pool which are connected to a main drain pipe 192, by header 193 which periodically removes water from the circulation system at a flow rate representing an appropriate percentage of the water to be treated during a given time period such as an hour, twenty-four hours, or the like, as required by local law. The water W passes through the main drain line 192 controlled by a valve 194, under operation of a pump unit 196, and is discharged into a discharge line 198 leading to a filter system 210 of conventional form such as an HRU-4-30 manifold filter system. In addition, a pair of skimmers 200 and 202 are provided within the landing pool, baffle 50 and sidewall 54 respectively, and which are connected by way of header 203 to a skimmer line 204 to pump 206 which is in tandem with pump 196 and being cross-connected to the main drain line 192 by way of connection line 208. Pump 206 is connected at its discharge side to the common discharge line 198 leading to the manifold filter system 210. The tandem pump discharge line 198 terminates in a cross-connection line 212 which leads to or form the filter unit 210 by supply and return lines 214 and 216. Line 212 is appropriately provided with control valves 218 and 219 to control the flow to the filter system 210 through either line 214 or 216 as desired. In this case, with one line 214, selected as the supply line to the filter, the other line 216 becomes a return line. The water, after being filtered by the manifold filter system 210, may be appropriately returned directly to the landing pool 18 via line 216 under control of valve 220 and system return line 222 causing the water to enter the surge section **18*b* of the landing pool by plural inlets 229 to each side of that pool section within sidewalls 54, through a cross-connection line 226 and manifold 228**.

If desired, chlorine may be added to the water by causing a portion of the water flowing from the pump discharge line 198 to pass through a chlorine injector 228 within line 230 under control of a valve 232 under operation of a chlorine booter pump 234. The chlorine injector 228 is connected to a chlorinator 236 at a possibly remote location by line 238, the chlorine treated water passing to the system return line 222 through line 230 and a second control valve 240 downstream of booster pump 234. Thus, in a simplified treatment system, the water may be circulated for filtration continually. Periodically by operation of control valves 232 and 240 and pump 234, chlorine gas may be added to the water by chlorine gas injection, with the chlorine booseter pump 234 being appropriately controlled so as to operate upon the opening of valves 232 and 240.

While the invention has been particularly shown and described with reference to a preferred embodiment thereof, it will be understood by those skilled in the art that various changes in form and details may be made therein without departing from the spirit and scope of the invention. For instance, the flume sections may be alternately formed of gel coated molded fiberglass or the like.

What is claimed is:

1. In a water slide for an elevated earth mass or the like, said water slide including at least one flume mounted on the surface of said mass and curving about said mass along an extended descent path and having upper and lower ends, a starting pool for said at least one flume connected to said flume at its upper end, a landing pool connected to said flume at its lower end, means for circulating water accumulating in said landing pool back to said starting pool for gravity passage over said at least one flume back to said landing pool, the improvement wherein:

said at least one flume is formed of a plurality of end connected and end sealed modular molded plastic flume sections, each section being generally concave upwardly and being generally semi-circular in transverse cross-section and terminating along opposed edges in integral upwardly convex hand rails, said sections comprising at least straight sections with opposed sidewalls of common height and with straight hand rails at common height, curved sections having radially inner and outer walls with said radially outer walls being higher than said radially inner walls with the hand rail of each curved section for the radially outer wall being higher than that of the radially inner wall, and transition sections between the straight sections and the curved sections and between curved sections of opposite throw, said transition sections being straight and having one of the hand rails inclined upwardly in the direction from one end thereof to the opposite end for connection to a radially outer wall hand rail of a given curved section.

2. The water slide as claimed in claim 1, wherein oppositely oriented, identical transition sections are provided between curved sections of opposite throw.

3. The water slide as claimed in claim 2, wherein each of said modular molded plastic flume sections terminates at its ends in right angle flanges extending outwardly from the surface of the sections facing said earth mass, said flanges of adjacent sections being bolted to each other, an arcuate spacer being interposed between said flanges and having an internal diameter slightly in excess of the internal diameter of said adjacent sections at said flanges, and said water slide further comprises an arcuate sealing strip interposed between said flanges and within the gap defined by said flanges and said spacer, and having an inner peripheral surface lying flush with the upper surface of said flume section facing away from said earth mass.

4. The water slide as claimed in claim 3, wherein said starting pool comprises a unitary, molded plastic element of generally rectangular, upwardly open, boxlike form including a bottom wall, opposed sidewalls and being closed at one end by a vertical end wall and open at the other end, said bottom wall being stepped adjacent the open end to form a seat, and said starting pool further comprises longitudinally extending steps extending between the sidewalls from said vertical wall towards said stepped bottom portion of said starting pool but terminating short thereof and defining a water inlet chamber baffle from the remainder of the starting pool, said steps having openings within the same to permit water flow from said water supply chamber to the area of said seat, and a water supply pipe mounted to said vertical wal. and projecting into said supply chamber and forming a portion of said means for circulating water from said landing pool to said starting pool.

5. The water slide as claimed in claim 4 wherein said modular molded plastic flume sections further comprise a starting flume section fixedly mounted to the open end of said starting pool and acting as an extension thereof, said starting flume section comprising a molded plastic element having a bottom wall and opposed sidewalls and opening upwardly, said sidewalls terminating in integral upwardly convex hand rails, one end of said starting flume section being connected to the open end of said starting pool having a rectangular transverse cross-section, the other end of said starting flume section being connected to one of said modular molded plastic flume sections with said other end of said starting flume section being generally semi-circular in transverse cross-section corresponding to that of the molded plastic flume section to which it is mounted and having like dimensions.

6. The water slide as claimed in claim 5, wherein said landing pool comprises a unitary molded element of generally rectangular plan configuration and being formed of a bottom wall, opposed end walls and opposed sidewalls and being upwardly open, said landing pool underlying the lower end of said at least one flume, a transverse vertical barrier within the bottom wall of said landing pool spaced some distance from said end walls and defining a first splashdown section of generally equal depth adjacent the lower end of said at least one flume, said bottom wall tapering upwardly from said barrier in a direction away from said splashdown section and towards said end wall remote from said at least one flume and forming an inclined surge section, and wherein said end wall remote includes steps and defines with said bottom wall and opposed sidewalls and said barrier, said landing pool surge section.

7. The water slide as claimed in claim 6, further comprising a molded plastic end landing section connected to the lower end of said flume adjacent the splashdown section of said landing pool and partially overlying the end wall of said landing pool at said splashdown section, said end landing section including opposed triangular shaped sidewalls and an inclined front wall spanning between the sidewalls and being integral therewith, the lower edge of said front wall being flat and in abutment with the upper edge of said end wall of said landing pool at said splashdown section and the upper edge of said front wall of said end landing section having a radius of curvature conforming to the semic-circular transverse cross-section of said modular plastic flume section attached thereto, and wherein opposed side edges of said inclined front wall are curved at their upper ends to conform to the upwardly convex curvature of the opposed hand rails of the modular molded plastic flume section coupled thereto; whereby, a smooth and relatively steep flow transition of the water occurs from said flume at its lower end to the splashdown section of the landing pool.

8. The water slide as claimed in claim 7, further comprising a plurality of main drain openings within the bottom wall of said landing pool within said surge section adjacent the transverse surge barrier, a main drain line extending from said landing pool and connected to said plurality of main drain openings, skimmer openings within at least the sidewalls of said landing pool, a skimmer line commonly connected to said skimmer openings, water return openings within said sidewalls of said landing pool spaced from said skimmer openings, a return line commonly connected to said water return openings, said water slide further comprising a chlorinator and a water filter, at least one pump having a suction side connected to the main drain line and said skimmer line and a discharge side connected to the inlet side of said filter, said filter being connected at its outlet to said return line and a bleed line operatively connecting said chlorinator to said pump discharge line and said return line and bypassing said filter; whereby, operation of said at least one treatment pump effects filtering of said water and return to said landing pool and chlorination of a portion of the water circulated by said treatment pump.

9. The water slide as claimed in claim 8 wherein said means for operatively connecting said chlorinator to said water circulated by said treatment pump comprises a chlorine injector and a chlorine booster pump operatively in series within said bypass line, a line connecting said chlorinator to the chlorine injector such that by operation of said chlorine booster pump water removed from said treatment pump discharge line causes chlorine to be injected from said chlorinator at said injector to effect chlorination of a portion of the water circulating between the landing pool and the filter system.

10. The water slide as claimed in claim 9, wherein said flumes are at least two in number, said landing pool is common to all of said flumes, each of said flumes includes a separate starting pool at the upper end thereof, said means for circulating water from the landing pool to said at least one starting pool comprises a plurality of return pipes connected to said landing pool at one end and connected to a common suction header at their other end, a plurality of motor driven pump units in excess of the number of starting pools and flumes and including suction and discharge sides, the suction sides of said pumps being connected to said common suction header by individual shut off valves, the discharge sides of said pumps being connected to a common discharge header by way of individual check valves, the supply pipes for each of said starting pools being connected to said common discharge header through shut off valves such that the number of pump units may be operated corresponding to the number of flumes in desired use, and wherein a given one of said pump units may be shut down and isolated from said common suction and discharge headers to permit maintenance, repair of replacement, while the remaining pump units operate at a capacity capable of circulating sufficient water between the common landing pool and the starting pools for all of said at least two flumes.

11. The water slide as claimed in claim 7, wherein said flumes are at least two in number, said landing pool is common to all of said flumes, each of said flumes includes a separate starting pool at the upper end thereof, said means for circulating water from the landing pool to said at least one starting pool comprises a plurality of return pipes connected to said landing pool at one end and connected to a common suction header at their other end, a plurality of motor driven pump units in excess of the number of starting pools and flumes and including suction and discharge sides, the suction sides of said pumps being connected to said common suction header by individual shut off valves, the discharge sides of said pumps being connected to a common discharge header by way of individual check valves, the supply pipes for each of said starting pools being connected to said common discharge header through shut off valves such that the number of pump units may be operated corresponding to the number of flumes in desired use, and wherein a given one of said pump units may be shut down and isolated from said common suction and discharge headers to permit maintenance, repair or replacement, while the remaining pump units operate at a capacity capable of circulating sufficient water between the common landing pool and the starting pools for all of said at least two flumes.

12. The water slide as claimed in claim 1, wherein each of said modular molded plastic flume sections terminates at its ends in right angle flanges extending outwardly from the surface of the sections facing said earth mass, said flanges of adjacent sections being bolted to each other, an arcuate spacer being interposed between said flanges and having an internal diameter slightly in excess of the internal diameter of said adjacent sections at said flanges, and said water slide further comprises an arcuate sealing strip interposed between said flanges and within the gap defined by said flanges and said spacer, and having an inner peripheral surface lying flush with the upper surface of said flume section facing away from said earth mass.

13. The water slide as claimed in claim 12, wherein said starting pool comprises a unitary, molded plastic element of generally rectangular, upwardly open, box-like form including a bottom wall, opposed sidewalls and being closed at one end by a vertical end wall and open at the other end, said bottom wall being stepped adjacent the open end to form a seat, and said starting pool further comprises longitudinally extending steps extending between the sidewalls from said vertical wall towards said stepped bottom portion of said starting pool but terminating short thereof and defining a water inlet chamber baffle from the remainder of the starting pool, said steps having openings within the same to permit water flow from said water supply chamber to the area of said seat, and a water supply pipe mounted to said vertical wall and projecting into said supply chamber and forming a portion of said means for circulating water from said landing pool to said starting pool.

14. The water slide as claimed in claim 1, wherein said starting pool comprises a unitary, molded plastic element of generally rectangular, upwardly open, box-like form including a bottom wall, opposed sidewalls and being closed at one end by a vertical end wall and open at the other end, said bottom wall being stepped adjacent the open end to form a seat, and said starting pool further comprises longitudinally extending steps extending between the sidewalls from said vertical wall towards said stepped bottom portion of said starting pool but terminating short thereof and defining a water inlet chamber baffle from the remainder of the starting pool, said steps having openings within the same to permit water flow from said water supply chamber to the area of said seat, and a water supply pipe mounted to said vertical wall and projecting into said supply chamber and forming a portion of said means for circulating water from said landing pool to said starting pool.

15. The water slide as claimed in claim 14, wherein said modular molded plastic flume sections further comprise a starting flume section fixedly mounted to the open end of said starting pool and acting as an extension thereof, said starting flume section comprising a molded plastic element having a bottom wall and opposed sidewalls and opening upwardly, said sidewalls terminating in integral upwardly convex hand rails, one end of said starting flume section being connected to the open end of said starting pool having a rectangular transverse cross-section, the other end of said starting flume section being connected to one of said modular molded plastic flume sections with said other end of said starting flume section being generally semi-circular in transverse cross-section corresponding to that of the plastic flume section to which it is mounted and having like dimensions.

16. The water slide as claimed in claim 14, wherein said landing pool comprises a unitary molded element of generally rectangular plan configuration and being formed of a bottom wall, opposed end walls and opposed sidewalls and being upwardly open, said landing pool underlying the lower end of said at least one flume, a transverse vertical barrier within the bottom wall of said landing pool spaced some distance from said end walls and defining a first splashdown section of generally equal depth adjacent the lower end of said at least one flume, said bottom wall tapering upwardly from said barrier in a direction away from said splashdown section and towards said end wall remote from said at least one flume and forming an inclined surge section, and wherein said end wall remote includes steps and defines with said bottom wall and opposed sidewalls and said barrier, said landing pool surge section.

17. The water slide as claimed in claim 16, further comprising a molded plastic end landing section connected to the lower end of said flume adjacent the splashdown section of said landing pool and partially overlying the end wall of said landing pool at said splashdown section, said end landing section including opposed triangular shaped sidewalls and an inclined front wall spanning between the sidewalls and being integral therewith, the lower edge of said front wall being flat and in abutment with the upper edge of said end wall of said landing pool at said splashdown section and the upper edge of said front wall of said end landing section having a radius of curvature conforming to the semi-circular transverse cross-section of said modular plastic flume section attached thereto, and wherein opposed side edges of said inclined front wall are curved at their upper ends to conform to the upwardly convex curvature of the opposed hand rails of the modular molded plastic flume section coupled thereto; whereby, a smooth and relatively steep flow transition of the water occurs from said flume at its lower end to the splashdown section of the landing pool.

18. The water slide as claimed in claim 1, wherein said landing pool comprises a unitary molded element of generally rectangular plan configuration and being formed of a bottom wall, opposed end walls and opposed sidewalls and being upwardly open, said landing pool underlying the lower end of said at least one flume, a transverse vertical barrier within the bottom wall of said landing pool spaced some distance from said end walls and defining a first splashdown section of generally equal depth adjacent the lower end of said at least one flume, said bottom wall tapering upwardly from said barrier in a direction away from said splashdown section and towards said end wall remote from said at least one flume and forming an inclined surge section, and wherein said end wall remote includes steps and defines with said bottom wall and opposed sidewalls and said barrier, said landing pool surge section.

19. The water slide as claimed in claim 18, further comprising a molded plastic end landing section connected to the lower end of said flume adjacent the splashdown section of said landing pool and partially overlying the end wall of said landing pool at said splashdown section, said end landing section including opposed triangular shaped sidewalls and an inclined front wall spanning between the sidewalls and being integral therewith, the lower edge of said front wall being flat and in abutment with the upper edge of said end wall of said landing pool at said splashdown section and the upper edge of said front wall of said end landing section having a radius of curvature conforming to the semi-circular transverse cross-section of said modular plastic flume section attached thereto, and wherein opposed side edges of said inclined front wall are curved at their upper ends to conform to the upwardly convex curvature of the opposed hand rails of the modular molded plastic flume section coupled thereto; whereby, a smooth and relatively steep flow transition of the water occurs from said flume at its lower end to the splashdown section of the landing pool.

* * * * *